United States Patent [19]

Hamano

[11] 4,085,932

[45] Apr. 25, 1978

[54] AMUSEMENT DEVICE FEATURING VARIABLE LIGHTING EFFECTS

[75] Inventor: Nubuo Hamano, Tokyo, Japan

[73] Assignee: Tomy Kogyo Co., Inc., Tokyo, Japan

[21] Appl. No.: 732,193

[22] Filed: Oct. 14, 1976

[51] Int. Cl.[2] ..... A63H 33/22; G09F 11/04

[52] U.S. Cl. ..... 272/8 P; 40/474; 40/581; 46/49; 362/281; 40/433

[58] Field of Search ..... 272/8 R, 8 D, 8 F, 8 M, 272/8 N, 8 P, 9, 10, 8.5, 31 R, 31 A, 31 B, 31 P; 273/142 A; 40/34, 106.52, 106.53; 46/49; 240/10.1

[56] References Cited

U.S. PATENT DOCUMENTS

| | | | |
|---|---|---|---|
| 1,182,266 | 5/1916 | Gibson | 272/8 P X |
| 1,796,903 | 3/1931 | Wheeler et al. | 240/10.1 X |
| 2,011,517 | 8/1935 | Geoffrion | 40/34 X |
| 3,195,400 | 7/1965 | Dlott | 272/10 X |
| 3,245,163 | 4/1966 | Allen | 40/34 |
| 3,526,983 | 9/1970 | Klauber | 40/106.53 |

FOREIGN PATENT DOCUMENTS

| | | | |
|---|---|---|---|
| 424,619 | 11/1933 | United Kingdom | 240/10.1 |

*Primary Examiner*—Richard C. Pinkham
*Assistant Examiner*—Arnold W. Kramer
*Attorney, Agent, or Firm*—Staas & Halsey

[57] ABSTRACT

An amusement device providing a variety of lighting effects in which a housing is provided with a source of light positioned below two transparent turntables mounted for rotation, a mechanism for rotating the turntables, an independently operated mechanism for varying both the direction and speed of rotation of one of the turntables relative to the other, and a plurality of discs provided with a variety of cut-out patterns to be positioned on top of the turntables.

10 Claims, 11 Drawing Figures

FIG. 5.
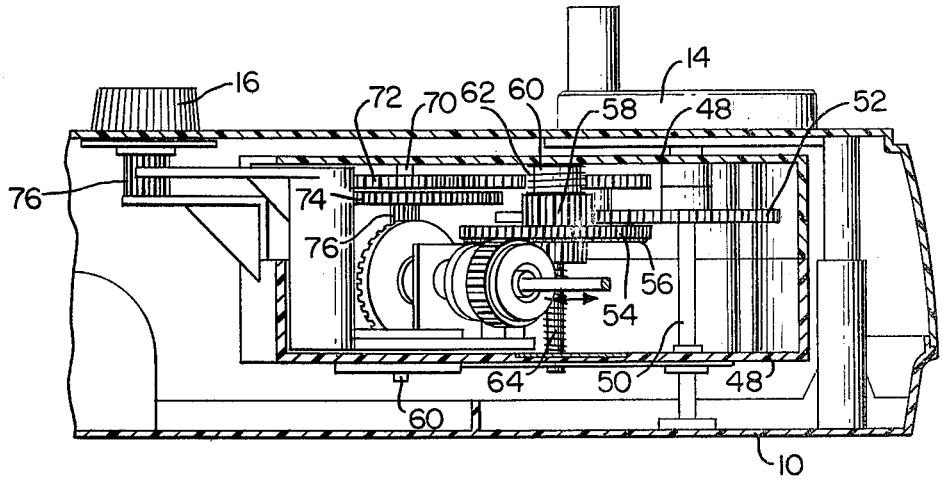
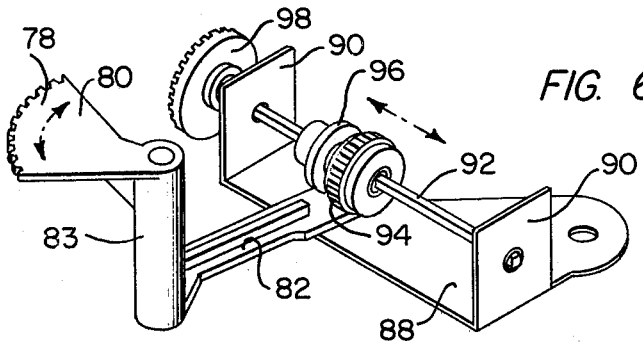
FIG. 6.
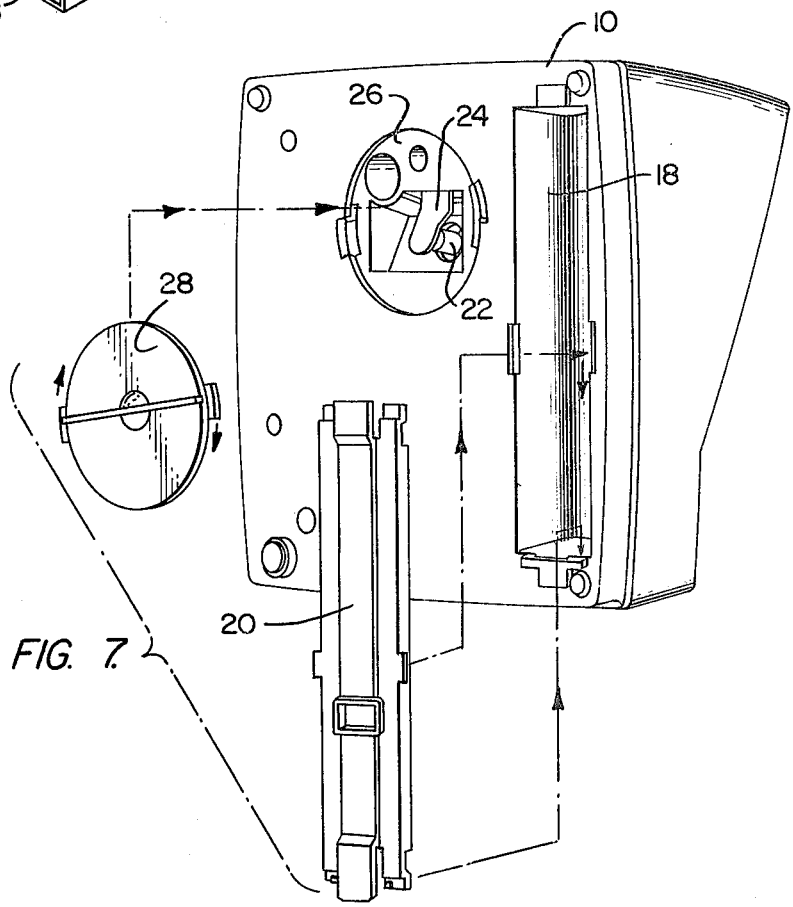
FIG. 7.

AMUSEMENT DEVICE FEATURING VARIABLE LIGHTING EFFECTS

BACKGROUND AND SUMMARY OF THE INVENTION

The present invention falls in the general category of amusement devices permitting a child to produce a variety of color patterns, and in particular to a toy wherein two transparent, rotatably mounted turntables are constructed to be simultaneously rotated with a first manually operable device, and wherein variation in the speed and direction of rotation of one of the turntables relative to the other turntable is achieved by operating a second manually operable device. Designed to be mounted on one or both of the turntables are a plurality of discs having varying cut-out patterns. A light is positioned below the rotating, transparent turntables such that as the controls are operated a variety of different colored, lighting patterns may be achieved.

BRIEF DESCRIPTION OF THE DRAWINGS

FIG. 5 is a sectional view taken along line 5—5 of FIG. 3 illustrating in particular the relationship of the gearing mechanisms to the manually operable controls on the face of the cabinet;

FIG. 6 is a perspective view of a portion of the gearing mechanism illustrating in particular the sliding gear which is responsible for reversing the direction of one of the turntables;

FIG. 7 is a perspective view of the bottom of the cabinet with certain of the compartments open to reveal the source of illumination and electrical energy.

DESCRIPTION OF THE PREFERRED EMBODIMENT

Figure 1:
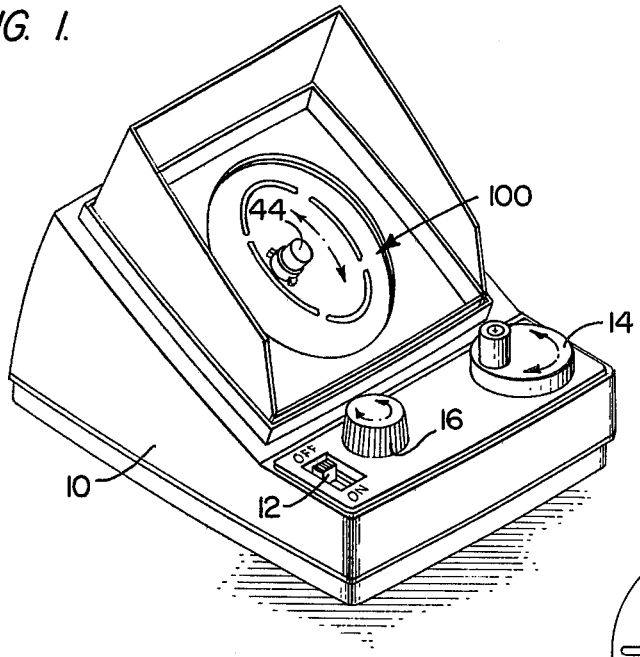
FIG. 1 is a perspective view of the amusement device illustrating the cabinet and the control mechanisms which include a first knob for rotating the turntables, a switch for turning the light "on" and "off", and a second knob for varying the direction and speed of rotation of one of the turntables relative to the other.
Figure 9:
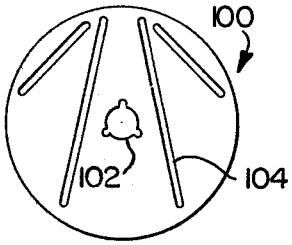
FIGS. 8–11 are top plan views of several discs which may be positioned on top of either or both of the turntables and which are provided with a variety of cut-out patterns through which light passes.
Figure 8:
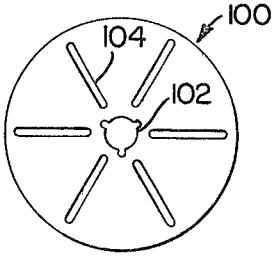
Figure 10:
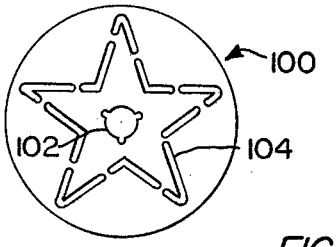
Figure 11:
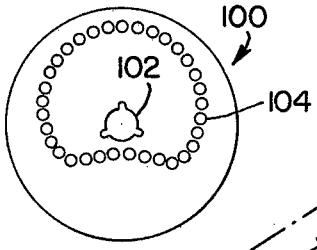

The cabinet 10 of the amusement device of the present invention, as illustrated in FIG. 1, is provided with controls, including an electrical switch 12, a rotatably mounted driving mechanism 14 and a rotatably mounted adjustment device 16. Reverting momentarily to FIG. 7 it will be apparent that the bottom of the cabinet 10 is provided with a housing 18 and a cover 20 therefor within which batteries (not illustrated) are located. In similar manner, a light bulb 22 and appropriate electrical fixture 24 is positioned within a housing 26 which is also provided with a cover 28. Appropriate electrical wiring (not illustrated) is used to connect the batteries within the housing 18 to the electrical fixture 24 such that when the switch 12 is turned to the "ON" position the lamp 22 is illuminated.

Figure 2:
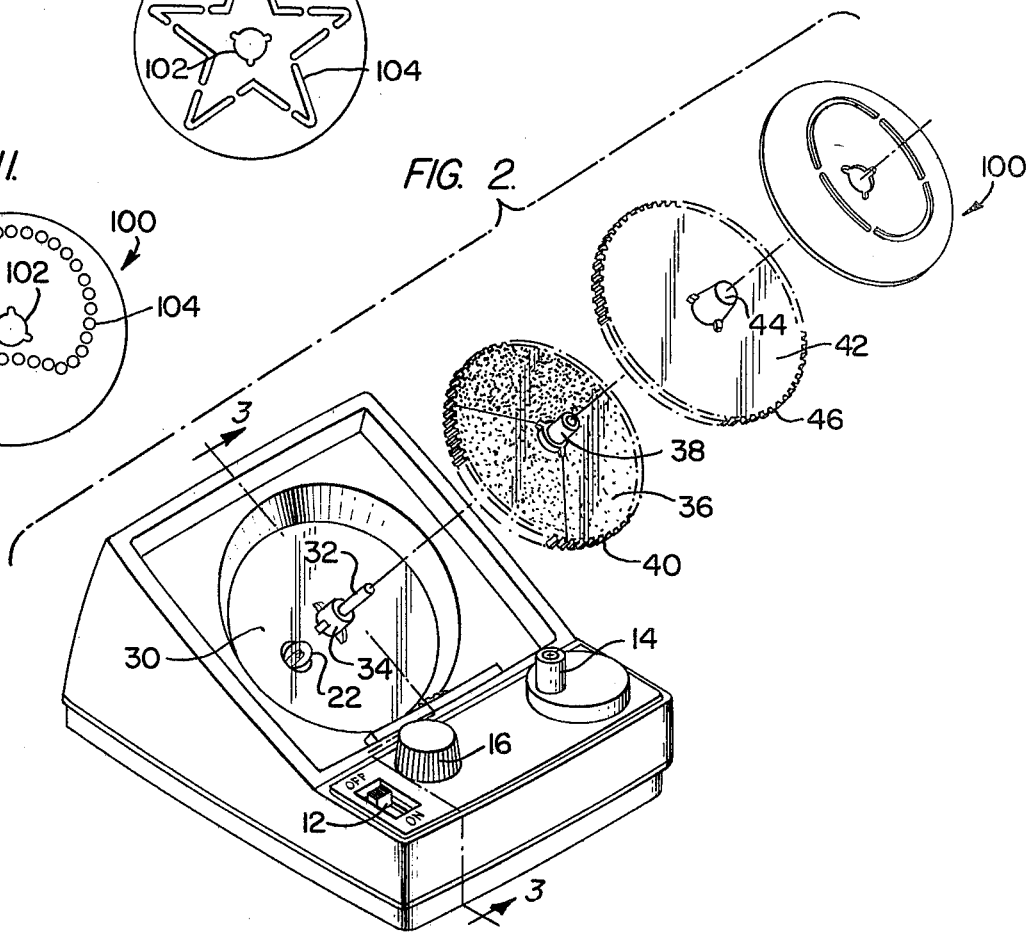
FIG. 2 is a perspective view of the amusement device with the two turntables and one of the discs shown in exploded relationship.
Figure 3:
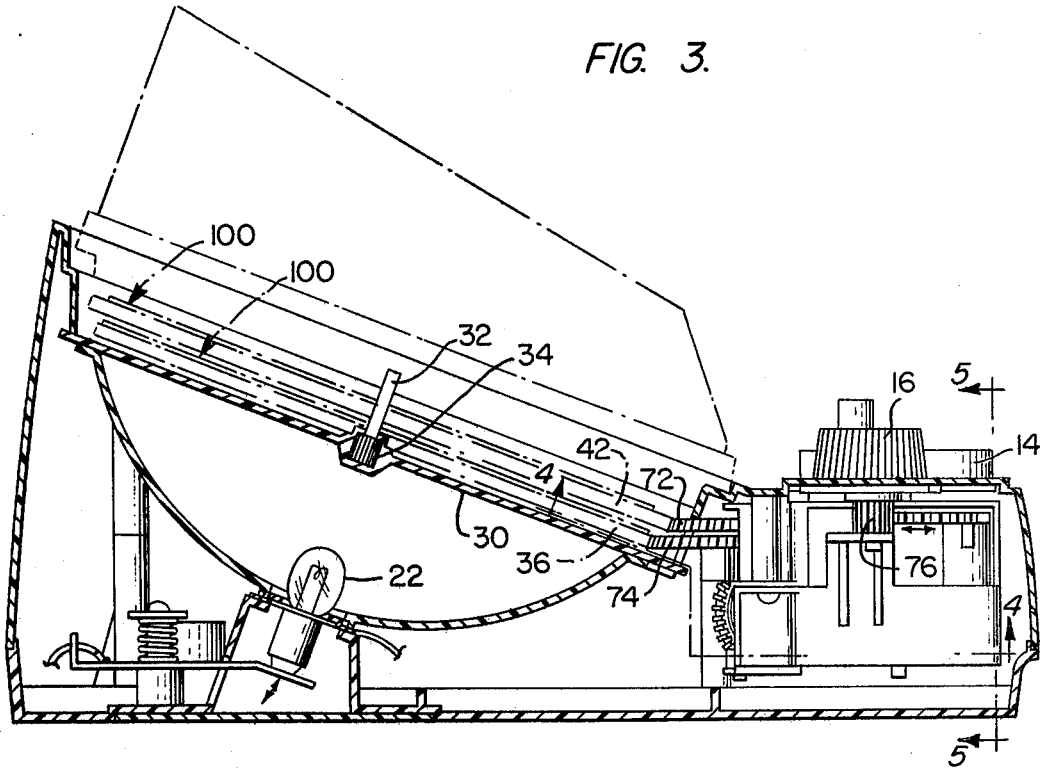
FIG. 3 is a sectional view taken along line 3—3 of FIG. 2 illustrating the component parts.

Turning now to FIGS. 2 and 3, it will be apparent that a transparent plate 30 is suitably mounted within the cabinet 10 above the lamp 22, and a shaft 32 is secured within the wall 34 of the plate 30. A first turntable 36 is provided with a hub 38 which is mounted over the shaft 32 permitting the turntable 36 to rotate. It will be apparent from the shading of the turntable 36, as illustrated in FIG. 2, that three different colors may be employed to create desirable lighting effects. Along the periphery of the turntable 36 there is provided a rack of continuous teeth 40.

A second turntable 42 is provided with a hub 44 which fits over the hub 38 of the turntable 36 in such a manner as to permit the second turntable 42 to rotate about the shaft 32. The turntable 44 is also provided along its periphery with a continuous rack of teeth 46.

The gearing mechanisms for rotating the turntables 36 and 42 are mounted within a chassis 48 which, as illustrated in FIGS. 3 and 5, is appropriately mounted within the cabinet 10. From FIGS. 3–5, it will be apparent that the driving mechanism or knob 14 is fixedly secured to a shaft 50 which is appropriately journalled within the walls of the chassis 48 for rotation. Fixedly secured to the rotating shaft 50 is a gear 52.

Figure 4:
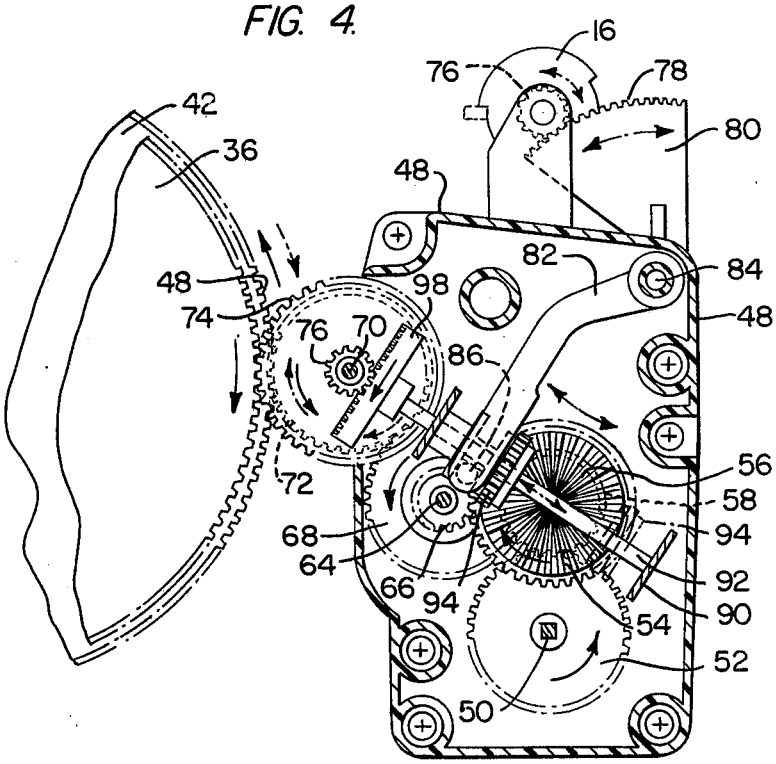
FIG. 4 is a sectional view taken along line 4—4 of FIG. 3 illustrating in particular the gearing mechanisms responsible for reversing the direction of rotation of one of the turntables.

The reference numeral 54 designates a gear wheel which, as illustrated in FIG. 4, is provided along the top surface thereof with radially extending ribs 56 which function, as described hereinafter, as teeth. Above the gear wheel 54 is located a smaller gear 58. The gears 54 and 58 are formed as an integral part of the shaft 60 which, as illustrated in FIG. 5, is appropriately journalled at one end to a wall of the chassis 48. Surrounding the shaft 60 is a spring 62 which tends to urge the gears 54 and 58 away from the wall of the chassis 48.

The shaft 64 is also appropriately journaled for rotation with respect to the walls of the chassis 48 and, as seen in FIG. 4, is provided with gear wheels 66 and 68 which are integrally formed as a single unit fixedly secured to the shaft 64. The teeth of the gear wheel 54 mesh with the teeth of the gear wheel 66.

A still further shaft 70 is journalled for rotation with respect to the walls of the chassis 48. Mounted for rotation about the shaft 70 is a gear 72, the teeth of which mesh with the teeth of gear 68. In similar manner, a gear 74 is mounted to rotate freely with respect to the shaft 70 and formed as an integral part thereof is a smaller gear 76.

From the foregoing, it will be apparent that as the driving mechanism or handle 14 is rotated the gear 52 fixedly secured to the shaft 50 rotates in the direction indicated in FIG. 4. Since the gears 52 and 58 mesh with each other, and since the gears 58 and 54 are an integral part of each other, the gear 54 is thus caused to rotate. Moreover, since the gears 54 and 66 mesh with each other, the gear 66, and the larger gear 68 which is an integral part thereof, is caused to rotate. Since the gears 68 and 72 mesh, rotation of gear 68 in turn causes the gear 72 to rotate. Since the teeth of the gear 72 mesh with the continuous rack of teeth 46 of the turntable 42 it is apparent that rotation of the gear 72 causes the turntable 42 to rotate.

The mechanism for causing the direction of rotation and the speed of the turntable 36 to be varied with respect to the turntable 42 will now be described. As seen in FIGS. 3–4, the adjustment device or knob 16 is mounted for rotation with respect to the cabinet 10 and is provided at the bottom thereof with a gear 76 having teeth which mesh with a continuous rack of teeth 78 which are provided on the flange 80 of an operating arm 82 which, as illustrated in FIG. 4, is mounted to rotate about the hub 83 which is mounted to the chassis 48 for rotation. It will be apparent, as illustrated in FIG. 6, that the arm 82, which is mounted for rotation about a shaft 84 formed as an integral part of the chassis 48 and which extends through the hub 83, is provided at the end thereof with an abutment 86 (FIG. 4). A support 88 having upstanding flanges 90 is appropriately secured to chassis 48 and is provided, as illustrated in FIG. 6, with a shaft 92 mounted to rotate with respect to the flanges 90. It will be apparent that the shaft 92 is square in cross-section and mounted for sliding movement thereon is a gear wheel 94 having spaced therefrom an upstanding disc-like wall 96. From FIG. 4, it is apparent that the abutment 86 of the rotating arm 82 is positioned between the gear 94 and the disc-like wall 96 in such manner that, as illustrated in FIG. 6, rotation of the arm 82 causes the gear 94 to slide along the shaft 92. Secured to the end of the shaft 92 is a spur gear 98 having teeth that mesh with the teeth of the gear 76 which is attached to the larger gear 74. From the foregoing, it will be apparent that when the adjustment device or knob 16 is in the position illustrated in FIG. 4 the clockwise rotation of the gear 54 causes the radially oriented teeth 56 to mesh with the teeth of the gear wheel 94 in turn causing the shaft 92 and the spur gear 98 attached thereto to rotate in the direction illustrated in FIG. 4 which in turn causes the gear wheel 76 and the gear wheel 74 to rotate in one direction which in turn causes the turntable 36 to rotate in one direction. But as the adjustment device or knob 16 is rotated, the engagement of the teeth of the gear 76 with the continuous rack of teeth 78 of the flange 80 causes the arm 82 to rotate in turn causing the gear wheel 94 to slide along the shaft 92. It will be apparent that as the gear wheel 94 slides along the shaft 92 it eventually passes the center of rotation of the gear wheel 54 at which time the gear wheel 94 begins to rotate in the opposite direction. During the time that the gear wheel 94 moves along the shaft 92 towards the center of the gear wheel 54, the speed of rotation of the gear wheel 94 also gradually decreases. When the gear wheel 94 reaches the position illustrated generally by phantom lines in FIG. 4, it will be apparent that the gear wheel 94 is rotating in the direction opposite to that previously described, and, moreover, is once again achieving the same rotational velocity as previously described.

Returning to FIGS. 1 and 2, the reference numeral 100 designates discs which are provided with openings 102 in the centers thereof and which are designed to be positioned on top of the transparent turntables 36 and 42. The discs 100 are provided with cut-out portions designated by the reference numeral 104 which, as seen in FIGS. 1 and 8–11, are arranged in a wide variety of patterns. The configurations illustrated in the figures, as noted above, and merely exemplary as it will be apparent that virtually an indefinite number of such configurations is possible. The child may position the discs 100 on top of either or both of the turntables 36 and 42 when using the amusement device of the present invention. When the discs 100 are so positioned on top of the turntables 36 and/or 42 the handle 14 is rotated either in the clockwise or counterclockwise direction, the result of which is to rotate the turntables 36 and 42. Light from the bulb 22 passes upwardly through the transparent plate 30 and turntables 36 and 42 and through only the cut-out portions 104 of the discs 100. Then, the child adjusts the position of the knob 16, the result of which is to change the rotational velocity of the turntable 36. From one extreme position of the knob 16 to the other it will be apparent that the turntable 36 may rotate at approximately the same rotational velocity as the turntable 42 and in the same direction through the entire range of slowing down, stopping, moving in the opposite direction to finally achieve rotational velocity of the same magnitude in the opposite direction, the result of which is to provide for a wide variety of light patterns being emitted through the cut-out portions 104 of the discs 100. As indicated previously, the discs 100 may be positioned only on the top turntable 42 or on both turntables, and as previously noted, the lower turntable 36 may be provided with different colors so as to further enhance the lighting effects of the amusement device.

I claim:

1. An amusement device, comprising a housing, a light source within said housing, first and second transparent turntables mounted for rotation with respect to said housing, means rotating said first and second turntables and means permitting the direction and speed of rotation of said second turntable to be varied with respect to said first turntable, including a first gear wheel mounted for rotation and having radially extending ridges on one face thereof, a shaft mounted for rotation, a second gear mounted to slide along said shaft and including teeth along the periphery thereof which mesh with said ridges of said first gear wheel such that as said second gear slides along said shaft the direction and speed of rotation of said second gear is varied, and a disk associated with at least one of said turntables, said disk provided with a cut-out pattern of predetermined configuration.

2. An amusement device as in claim 1, wherein said first turntable is provided with different colors to create lighting effects.

3. An amusement device as in claim 1, wherein said means rotating said turntables further comprises a handle mounted for movement on said housing, teeth provided along the peripheries of said turntables, teeth formed along the periphery of said first gear, and gear means operatively connecting said handle and said teeth of said first turntable through said teeth of said first gear, and gear means operatively connecting said shaft and said teeth of said second turntable.

4. An amusement device as in claim 3, wherein means permitting variation in direction and speed of rotation of said second turntable further comprises a second handle mounted for movement on said housing, and means operatively connecting said second handle to said second gear such that as said second handle is turned said second gear slides along said shaft.

5. An amusement device as in claim 4, including a transparent plate mounted within said housing, a shaft mounted to said transparent plate and extending outwardly therefrom, said first and second turntables being mounted to rotate with respect to said shaft.

6. An amusement device as in claim 5, including additional discs to be mounted upon at least one of said turntables and each such disc provided with a different cut-out pattern.

7. In an amusement device having a housing provided with a light source and first and second turntables mounted to rotate with respect to the housing, the improvement comprising a gearing mechanism for rotating both turntables while permitting the direction and speed of rotation of one of said turntables to be varied with respect to the other of said turntables, including a gear train connected to one of said turntables for rotating same, and including a first driving gear wheel provided with radially extending ridges on one face thereof, a shaft, a second driven gear wheel mounted to slide along said shaft such that the teeth thereof mesh with said ridges of said face of said first gear and with the position of said second gear being slid with respect to said first gear determining the direction and speed of rotation of said second gear, and means operatively connecting said shaft to the other of said turntables.

8. An amusement device as in claim 7, further comprising racks of teeth formed along the peripheries of said turntables, said gear train terminating in a third gear meshing with the teeth of one of said turntables, and wherein said means connecting said shaft and the other of said turntables comprises a fourth gear wheel affixed to said shaft meshing with the teeth of the other of said turntables.

9. An amusement device as in claim 8, further comprising a first manually operable mechanism connected to said gear train to operate same to rotate said one of said turntables and a second manually operable mechanism connected to said second gear to slide same along said shaft.

10. An amusement device as in claim 9, wherein said first and second turntables are transparent, and including at least one disk associated with one of said turntables and provided with a cut-out pattern of predetermined configuration.

* * * * *